United States Patent [19]

Guermonprez

[11] Patent Number: 4,799,524

[45] Date of Patent: Jan. 24, 1989

[54] PROTECTION AND/OR DECORATIVE DEVICE FOR APERTURES IN WALLS, WINDOWS AND THE LIKE

[76] Inventor: Claude Guermonprez, Saint Privaz 13790, Rousset, Bouches-du-Rhones, France

[21] Appl. No.: 75,962

[22] Filed: Jul. 21, 1987

[51] Int. Cl.[4] ..... E06B 3/94

[52] U.S. Cl. ..... 160/84.1; 160/168.1; 160/173

[58] Field of Search ..... 160/84 R, 236, 201, 160/178 C, 166 A, 172, 168.1, 173

[56] References Cited

U.S. PATENT DOCUMENTS

| | | | |
|---|---|---|---|
| 2,646,114 | 7/1953 | Kearny . | |
| 2,921,628 | 1/1960 | Alvarez | 160/201 |
| 3,727,665 | 4/1973 | Debs | 160/178 C |
| 3,946,788 | 3/1976 | van Muyen | 160/84 R |
| 4,202,395 | 5/1980 | Heck . | |
| 4,556,095 | 12/1985 | Lewis | 160/172 X |

FOREIGN PATENT DOCUMENTS

| | | | |
|---|---|---|---|
| 61284 | 9/1943 | Denmark | 160/84 R |
| 0093827 | 11/1983 | European Pat. Off. . | |
| 2934122 | 3/1981 | Fed. Rep. of Germany . | |
| 8511346 | 8/1985 | Fed. Rep. of Germany . | |
| 2162226 | 1/1986 | United Kingdom . | |

*Primary Examiner*—Ramon S. Britts
*Assistant Examiner*—Blair Johnson
*Attorney, Agent, or Firm*—Sandler & Greenblum

[57] ABSTRACT

This protection and/or decorative device for apertures in walls, windows or the like is intended notably for protecting private homes or commercial or industrial premises against the action of light, insects, or simply the occupants' intimacy, or simply for reasons of aesthetics, and is applicable notably to the construction of folding or raisable blinds, curtains or the like. This device comprises at least one folding or raisable screen (3), and means (4) for folding or raising the screen. This screen, whether of the folding or raisable type, consists of at least two retractable blinds (5, 6) having different functions and disposed one after another; these blinds are controlled separately and/or simultaneously by means of a common control device (7).

15 Claims, 3 Drawing Sheets

PROTECTION AND/OR DECORATIVE DEVICE FOR APERTURES IN WALLS, WINDOWS AND THE LIKE

BACKGROUND OF THE INVENTION

1. FIELD OF THE INVENTION

The present invention relates to means for protecting and/or decorating apertures in walls, such as windows or the like. This invention is directed more particularly to a device applicable notably to private houses or commercial or industrial buildings, for protecting the premises against the effects of light, and also against insects, or simply for protecting the private life of the occupants. It is also applicable to the manufacture of blinds, slatted blinds, roller-blinds or the like.

2. THE PRIOR ART

As a rule, for protecting apertues inwalls, such as windows or the like, against the effects of light and also against insects, or still for protecting the privacy of the occupants, or even simply for reasons of aesthetics, it is current practice to use all types of blinds, mainly retractable ones, as well as shutters, roller-blinds, hangings or the like, so that the apertures can be cleared when desired or neceessary.

In the particular field of protection against the detrimental effects of daylight, it is current practice to use roll-up devices such as slatted blinds, awning blinds, or blinds provided with a flexible protection screen advantageously of the accordion fold-up type. It may also be pointed out that the same types of devices are used for protecting the intimacy of the occupants.

On the other hand, as far as the protection against insects is concerned, use is made of rigid retractable screens, the socalled mosquito-curtains or nets, consisting of a rigid frame of a size consistent with the dimensions of the aperture to be protected, a flexible cellular material being stretched in this frame and permitting the diffusion of light while preventing the ingress of insects.

Finally, decorative devices are also known to which purely aesthetical functions are devolved. For example, these decorative devices may consist of blinds and/or hangings suspended at their top edges from small trolleys running or sliding in guide rails disposed horizontally above the aperture to be protected. However, in certain cases protection devices similar to those mentioned hereinabove are also used for decorative instead of functional purposes.

When the user wishes to combine several functions, the protection against the detrimental action of light, the protection against insects, the protection of the occupants' intimacy, or simply the decorative or aesthetical function, several devices each suitable for performing a specific function, are currently available, these devices being disposed by turns or simultaneously in parallel relationship in front of the aperture to be protected or decorated, or both.

Though these known devices are relatively satisfactory on the whole, they require the use of two separate devices, thus increasing unduly on the one hand the space occupied and on the other hand, indirectly, the final cost of the protection and/or decorative device.

In certain cases, these "parallel" devices cannot be installed because their overall dimensions are excessive or the assembly is unaesthetic. Moreover, in some constructions such as a transportable house, a mobile home, a caravan, a boat, or the like, in addition to the space occupied the ocst factor should not be disregarded.

SUMMARY OF THE INVENTION

It is the essential object of the present invention to provide a protection and/or decorative or ornamental device to be fitted in front of apertures in walls, such as windows or the like, for use notably as a means for protecting the interior against the detrimental action of light and/or insects, or for protecting the occupants' intimacy, or for aesthetic reasons, this device being capable of palliating the various inconveniences set forth hereinabove, by providing a multi-purpose device having overall dimensions similar to those of a single-purpose device of this type, at a cost which is appreciably lower than that of conventional, so-called "parallel" devices.

It is a primary object of the present invention to provide a protection and/or decorative or ornamental device for openings in walls, such as windows or the like, which permit of combining a plurality of functions, such as the protection against the action of light and/or insects, the protection against the action of light and/or the protection of privacy, and/or obtaining two or more ornamental designs, in a same and single device which is both simple and economical.

Another object of the present invention consists in providing a protection and/or decorative or ornamental device for apertures in walls, windows or the like, this device being adapted, by using a common control system, to provide the various functions separately and/or simultaneously.

It is a further object of the present invention to povide a protection and/or decorative or ornamental device for apertures in walls, windows or the like, this device being adapted, by using a common control system, to provide the various functions separately and/or simultaneously.

It is a further object of the present invention to provide a protection and/or decorative or ornamental device for apertures in walls, windows or the like, which can be set in several intermediate positions, so that the user can protect him- or herself against the external light on a predetermined area of the aperture, the remaining area being protected for example against the ingress of insects.

Other features and advantages of the present invention will appear as the following description proceeds with reference to the accompanying drawings.

According to the instant invention, the protection and/or decorative or ornamental device for apertures in walls, windows or the like, notably for protecting the occupants from the detrimental action of light, or insects, and/or for protecting the intimacy of the interior, and/or for aesthatic reasons, comprises at least one folding or raisable screen, and means for controlling the folding and raising of said screen consists of at least two retractable blinds having different functions, said blinds being disposed one after another and controlled separately and/or simultaneously at will, by means of a common control system.

THE DRAWINGS

DESCRIPTION OF THE PREFERRED EMBODIMENTS

Figure 1:
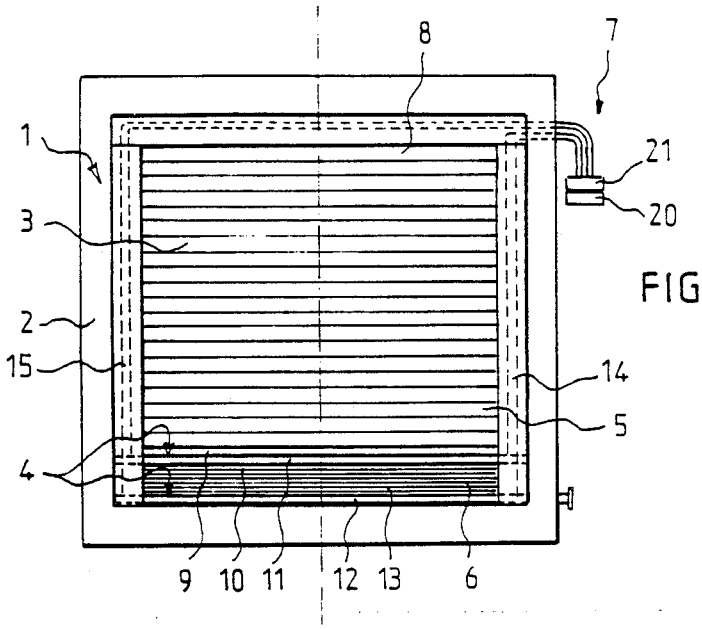
FIG. 1 is a front elevational view of a protection and/or decorative or ornamental device according to a first form of embodiment of the present inention.

The present invention is directed to provide an improved protection and/or decorative or ornamental device for apertures in walls, windows or the like. Fron the onset, the terms "apertures in walls, windows or the like" should be taken in their broadest meaning, for it may designate not only conventional masonry walls but also compound walls and partitions such as commonly used in the construction of caravans, boats, mobile homes and transportable houses, or else. Moreover, although the protection and/or decorative or ornamental device of the present invention was developed primarily and more particularly for equipping transportable or mobile constructions, it is of course also applicable to conventional houses and to commercial and industrial buildings.

Up to now, when it is desired to protect or decorate such apertures, and when the means implemented therefore must be capable of performing several protective and/or decorative or ornamental functions, a plurality of "parallel" devices had to be disposed in front of the aperture, each device having its specific protection or decorative function.

In other works, a first function was obtained by disposing in the plane of the aperture or parallel thereto a first protection and/or decorative device, and when a second function was desired, a second device had to be fitted in parallel with the first device, each device having its specific control system so that the devices could be actuated separately.

With the device of the present invention, this cumbersome and expensive though conventional arrangement can be avoided.

In fact, according to the present invention, and as shown in the various Figures or the drawings, the protection and/or decorative or ornamental device 1 is disposed within the apertures 2 formed in the wall, such as a window or the like, or parallel thereto, and comprises at least one screen 3 of the folding or raisable type, and means 4 for folding or rolling up the screen 3.

According to the essential feature characterising the present invention, the folding or raisable screen 3 consists of at least two rectractable blinds 5, 6 to which different functions are devolved, respectively. These blinds 5, 6 are disposed one after another and actuated separately and/or simultaneously, at will, by means of a common control system 7. Therefore, the device of the present invention substitutes a "series" system for the hitherto conventional "parallel" system.

According to various possible forms of embodiment of the device of the present invention, the retractable blinds 5, 6 may consist of retractable or raisable blinds or the like, consisting of an assembly of slats, or of an accordion-pleated bland. This last-mentioned type is illustrated notably in FIGS. 1, 4 and 5 of the drawings.

On the other hand, the Figures illustrate blinds or curtains disposed in a vertical plane but having their apron folds disposed horizontally.

However, the features characterising the present invention could be transferred as wlel to slatted-band or accordion-pleated blinds having their apron folds disposed vertically and supported by a horizontal guide rail overlying the aperture to be protected.

The blinds or curtains may also be disposed above a horizontal plane, for instance over roof windows, ceiling windows, skylights, and the like.

In these last two cases, the blind is no more spread by the weight of the weighting bars, since these bars can move only horizontally. To palliate this inconvenience, a return cable system applicable to the existing control system is provided, but its functions are reversed so that the weighting bars can move in one or the other directions. In other words, the control system will be effective to fold the blind or blinds, the return cables being used for closing the blind or blinds.

As mentioned in the foregoing, the blinds 5, 6 are disposed one after another in a common plane which may either merge with the plane of the aperture or be shifted in parallel relationship thereto. One end 8 of the first blind 5 is either attached to the dormant frame of the aperture 2 to be protected and/or decorated, or at least fixed in relation thereto. The other end 9, that is, in the case illustrated in the drawings, the lower end of the first blind 5, will be attached to the upper end 10 of the second blind 6, so that a "series" assembly is obtained, in contrast to the hitherto conventional "parallel" assembly.

Besides, it will be seen that in the case of horizontal blinds, the means 4 for folding or rolling up the blinds are advantageously of the type comprising rigid weighted bars permitting on the one hand of weighting the lower ends of blinds 5, 6 and on the other hand of raising the blinds by either drawing the blades together in the case of slatted blinds, or closing the folds of the blinds in the case of accordion-pleated blinds.

Thus, the device 1 comprises first means 11 for raising the first blind 5, which consist essentially of a weighted bar attached to the lower end 9 of the first blind, and means 12 for raising the second blind 6, which consist essentially of a second weighted bar attached to the other or so-called lower end 13 of said second blind 6.

According to the present invention, the blinds 5, 6 are advantageously disposed in "series" or one after another by assembling them on either side of the first weighting and roll-up bar 11.

Thus, due to the selective action exerted on the first and second raising or lifting means 11, 12 and assuming that said means are both lowered, when the weighted bar 11 is raised the blind 5 will be raised and the second blind 6 will be unfolded, or alternatively when the second bar 12 is raised, both blinds 5 and 6 are raised simultaneously, unless the first blind 5 has not been raised so far, or only blind 6 if said first blind 5 has already been raised.

Figure 5A:
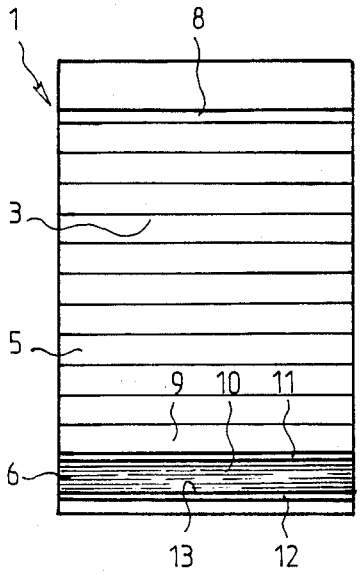

These various possibilities are illustrated notably in FIGS. 5*a* to 5*d*. FIG. 5*a* shows the two weighted bars 11 and 12 in their lower positions. In this case, the first blind 5 is unfolded or unrolled and the second blind 6 is folded or raised up between the two bars 11 and 12, so that the function of blind 5 is obtained.

Figure 5B:
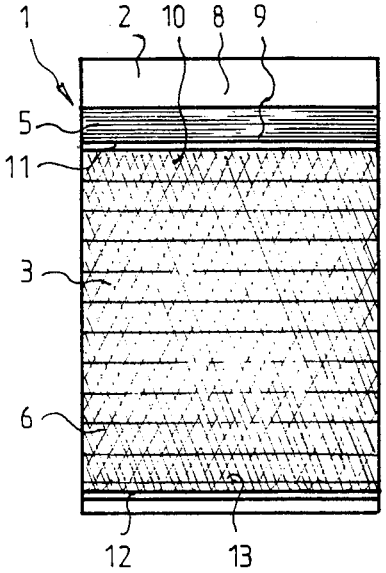

FIG. 5*b* illustrates the second function of the protection and decorative or ornamental device of the present invention, which is the function of blind 6. In fact, bar 11 has been pulled up and blind 5 is folded up between this bar 11 and the top of aperture 2. On the other hand, said bar 12 is in its lwoer position and thus the blind 6 is spread between bars 11 and 12.

Figure 5C:
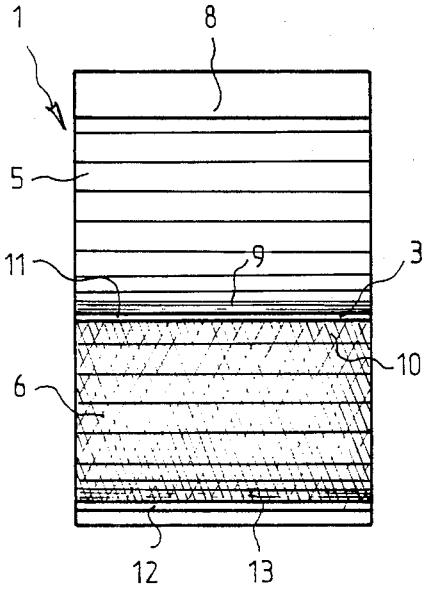

FIG. 5*c* illustrates an intermediate position among the multiple positions in which the two blinds 5, 6 can be set for combining their respective functions. Thus, for instance, the bar 12 is in its lower position and bar 11 in its intermediate position. Thus, between bar 11 and the top of aperture 2, the blind 5 provides the first function while the other blind 6, extending between bar 12 in its lower position and bar 11 in its intermediate position, provides a second function.

Figure 5D:
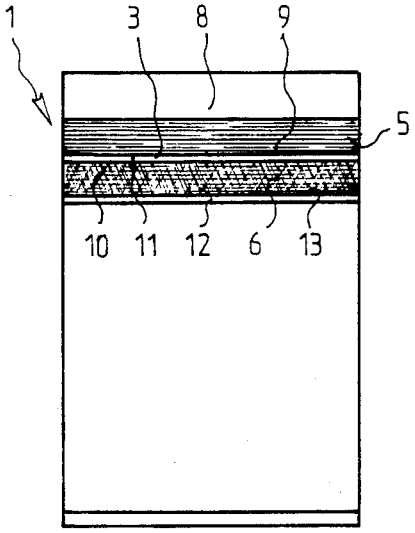

Finally, FIG. 5*d* shows the screen 3 of device 1 in its fully raised position and both blinds are folded between the top of aperture 2 and bar 11, then between bar 11 and bar 12, respectively. Thus, the aperture 2 is cleared completely and therefore it is no more subjected to the protective and/or decorative effects of the the present invention.

By way of example, the device 1 of the present invention, designed notably for the windows of caravans, mobile homes or the like, comprises a first blind 5 in the form of an opaque sheet pleated accordion-like and disposed horizontally to provide mainly an efficient protection against light, and/or a second blind 6 in the form of a sheet of close-woven material also pleasted accordion-like and disposed horizontally to provide essentially a protection against insects and/or a decorative effect.

Figure 3:
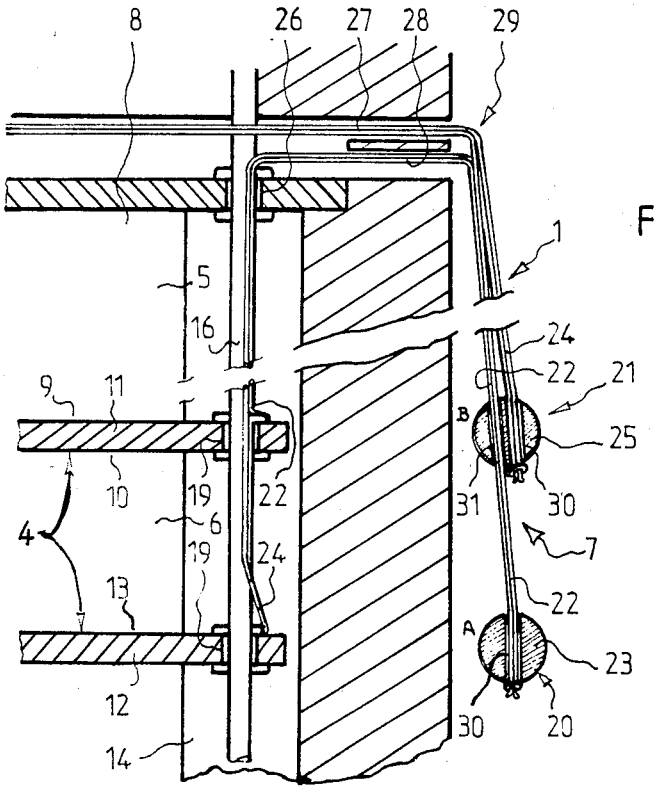
FIG. 3 illustrates on a larger scale and in vertical section a detail of the device of FIG. 1.
Figure 4:
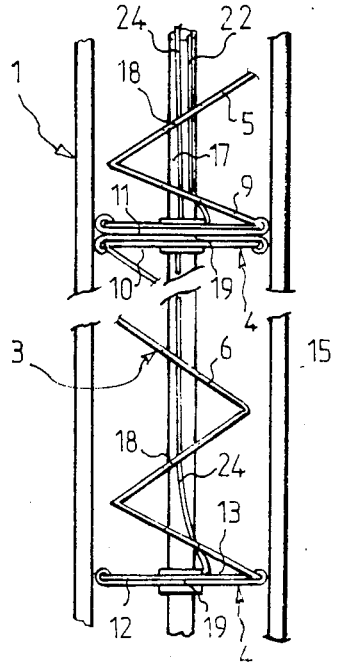
FIG. 4 is a fragmentary side elevational view and vertical section taken along the line IV—IV of FIG. 1, and FIGS. 5*a*–5*d* show various possible positions of the protection and/or decorative or ornamental multi-purpose device of the present invention.

Besides, in an advantageous form of embodiment of the present invention, the retractable blinds 5, 6 are disposed horizontally and the device 1 comprises lateal guide means consisting for example of slideways 14, 15, preferably U-section members, disposed on either sideof the lateral edges of blinds 5, 6 and engaged by the ends of the weighting and rollup bars 11, 12 of said blinds. This arrangement, illustrated more particularly in FIGS. 3 and 4, is obtained by using technical procedures well known to those conversant with the art.

Moreover, the lateral guide means comprise a rigid rod or a flexible guide cable 16, 17 extending oneither side at the level of slideways 14, 15, respectively. In this form of embodiment the retractable blinds 5, 6 and/or the weighting and roll-up bars 11, 12 are provided adjacent their ends with guide holes 16, 17 engageable by said rods or cables 16, 17 so that the blinds and/or bars can slide along said rods or cables.

According to another essential feature characterising the present invention, the device 1 comprises a single control system 7 for controlling the blinds 5, 6 separately and/or simultaneously. In other words, this control system 7 permits :

or raising or folding up separately the first blind 5 providing the first function, and then lowering or unfolding the second blind 6 providing the second function, of raising or folding up separately the second blind 6, the first blinds 5 having been raised or folded up beforehand, of raising or folding up simultaneously and together both blinds 5 and 6, the first blind 5 being unfolded while the other blind 6 is folded up, of simultaneously raising or folding up both blinds 5, 6 simultaneously, while said blinds are both in an intermediate position, of lowering or unfolding the second blind 6 separately, the first blind 5 remaining in the upper portion of aperture 2, of simultaneously lowering or unfolding both blinds 5, 6 to provide the function of the first blind 5, the second blind 6 being raised or folded up in the lower portion 9 of the first blind 5, and of simultaneously lowering or unfolding both blinds 5 and 6, to provide an intermediate position thereof between the first function and the second function.

In this respect, the control system comprises at least two control means 20, 21 independent of each other. The first means denoted A and bearing the reference numeral 20 is adapted to actuate notably said first folding or raisable means 11 of the first blind 5, the second means, denoted B and bearing the reference numeral 21, being adapted to actuate the second folding or raisable means 12 of the second blind 6.

Moreover, said first and second control means 20 and 21 are adapted to be interconnected for folding or rolling up simultaneously both blinds 5, 6 by effecting a single control action, as explained hereinabove.

According to the form of embodiment described in the foregoing by way of example, the device 1 comprising two retactable blinds 5, 6 of the slatted or accordion-pleated folding type, and/or the accordion-pleated band-type protection and/or decorative or ornamental blinds, said bands or slats are disposed horizontally with respect to the aperture 2 to be protected or decorated. The control means 20, 21 consist essentially of a system of cables, ropes, cords, tapes or the like, provided with grip handles.

More particularly, the first control means 20 comprises an assembly of pullup cables 22 having one end attached to one side of the first weighting bar 11 of said first blind 5 and the other end provided with a control handle 23.

The second means 21 consists likewise of an assembly of lifting cables or like means 24 attached at one end to said second bar 12 of blind 6, and at the other end to a second control handle 25. However, it will be seen that the second control handle 25 is adapted to guide and allow the free sliding movement of said lifting cables 22 of the first control means 20, and that the length of said lifting cables 22 and 24 of said first and second control means 20, 21 respectively is such that when the two blinds 5, 6 are fully lowered, with the first blind lowered and the second blind rolled up or folded, said first and second handles 23, 25 substantially abute each other.

Figure 2:
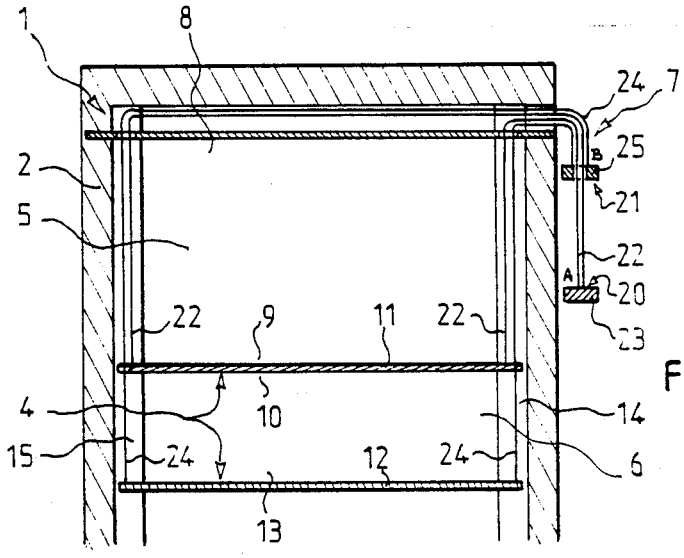
FIG. 2 is a fragmentary vertical section showing the mode of operation of the device of FIG. 1.

In the arrangement illustrated, notably in FIGS. 2, 3 and 4, the lifting cables 22, 24 of the first and second control means 20, 21 are disposed at the same level as said guide means 16, 17 and extend through said guide holes 18, 19, respectively.

Moreover, each cable assembly 22, 24 consists of a single cable, rope, cord, tape or the like, attached on either side of bars 11, 12 at the level of said guide hole 19. Then, the cables or like means are tensioned vertically along tubular members 16, 17 and then through a series of orifices 26, 27, 28 from which they emerge at 29, and subsequently bent towards the control handles 23, 25 to which they are attached, respectively.

In this respect, the control handle consists roughly of tassels provided with at least one through hole 30 in which the cable or cables is or are passed for fixing the tassels thereto.

On the other hand, the second control tassel 25 comprises an additional hole 31 for guiding and permitting the free sliding movements of the lifting cables 22 of the first control system 20.

Moreover, the length of the lifting cables 22 and 24 is so adjusted that the first control system A 20 abutes the second system B 21 substantially at the level of the upper portion of the device 1, but not compulsorily, when the blind 3 is fully lowered, i.e. when the weighting bar 12 is level with the lower portion of the aperture to be protected and/or decorated, when the other weighting bar 11 of the first blind 5 is in its lower position and the second blind 6 is folded or rolled up completely between bars 11 and 12. This is shown notably in FIG. 1.

Thus, by actuating the control system B, due to its abuting engagement position with respect to the other control system A, both blinds 5, 6 can be raised simultaneously.

Of course, other forms of embodiment of the present invention may be contemplated by those conversant with the art, without departing however from the basic principles of the invention. Thus, notably, many combinations of protection blinds and all kinds of relative positions thereof may be contemplated within the scope of the invention.

Besides, though the device of the present invention is intended primarily for use more particularly with horizontal blinds, it is also possible to contemplate the use of the same device in a vertical position to provided a multi-function folding blind system, the conversion being of course within the understanding of those conversant with the art.

What is claimed is:

1. A device for covering an aperture in a wall, said device comprising:

a screen that is adapted to be raised and lowered, which screen comprises a first retractable blind and a second retractable blind, said first and second blinds being disposed adjacent to each other;

means for raising and lowering said screen, said raising and lowering means comprising first means for raising and lowering said first blind and second means for raising and lowering said second blind;

each of said first and second blinds comprising foldable structures having first and second opposed ends, wherein the first end of said first blind is attachable to an upper portion of an aperture in a wall, the second end of said first blind is connected to said first means for raising and lowering said first blind and is also attached to said first end of said second blind, and the second end of said second blind is connected to said second means for raising and lowering said second blind;

a common control means comprising at least a first control system that controls said first means for raising and lowering said first blind and a second control system that controls said second means for raising and lowering said second blind, wherein said common control means is adapted to control said first and second control system so as to selectively operate either control system independently, wherein said first and second blinds can be raised or lowered independently, and to selectively control said first and second control systems simultaneously, wherein said first and second control systems cooperate together to raise and lower said first and second blinds simultaneously;

said first control system comprising first means for applying a force to said first means for raising and lowering said first blind,wherein said first means for applying a force is connected at one end to said first means for raising and lowering said first blind and is conneted at a second end to a first handle means;

said second control system comprising second means for applying a force to said second means for raising and lowering said second blind, wherein said second means for applying a force is connected at one end to said second means for raising and lowering said second blind and is connected at a second end to said second handle means; and wherein said first means for applying a force extends through said second handle means is sliding relation thereto.

2. The device of claim 1 wherein said foldable structures of said first and second blinds comprise folding slats or accordion-pleated bands disposed horizontally with respect to the aperture, and said first and second means for raising and lowering said blinds comprise rigid horizontal bar members which are of sufficient weight to cause the individual blinds to extent across the aperture under the influence of gravity.

3. The device of claim 1, wherein said first and second means for applying a force comprise cables, cords or tapes.

4. The device of claim 1, wherein said first and second means for applying a force have lengths such that when said first means for raising and lowering said first blind and said second means for lowering said second blind are in lowermost positions, said first and second handle means are adjacent each other.

5. The device of claim 1 wherein said first and second blinds comprise means for blocking light, preventing insects from passing therethrough, providing privacy or decoration.

6. The device of claim 1 further comprising means for guiding lateral edges of said first and second blinds.

7. the device of claim 6 wherein said guide means comprise "U"-shaped channels that extend vertically on said lateral edges of said first and second blinds.

8. The device of claim 7 wherein said first and second blinds adn said first and second means for raising and lowering said blinds have guide holes therein and said guide means further comprise guide members that pass through said guide holes.

9. The device of claim 8 wherein said first and second means for applying a force have portions that are positioned adjacent to said guide members and pass through said guide holes.

10. The device of claim 1 wherein one of said first or second blind comprises an opaque, horizontal, accordion-pleated curtain having a light-occulting function and the other of said first or accordion-pleated material capable of preventing insects from passing therethrough.

11. A device for covering an aperture in a wall comprising:

a screen that is adapted to be raised or lowered, which screen comprises a first retractable blind and a second retractable blind, said first and second blinds being disposed adjacent to each other;

each of said first and second blinds having first and second opposed ends wherein the first end of said first blind is attachable to an upper portion of an aperture in a wall and the second end of the first blind is connected to said first end of said second blind;

a first control system that is connected to, and controls, said first blind, and a second control system that is connected to, and controls, said second blind; and a first handle attached to said first control system and a second handle attached to said second control system, wherein said first control system is slidably connected to said second handle.

12. The device of claim 11 wherein said second handle includes a single aperture and wherein said second control system passes through said aperture in said second handle.

13. The device in claim 11 wherein said first handle includes a single aperture in which said first control system is fixedly attached and said second handle contains two apertures, said second control system being fixedly attached to one of said two apertures, said first control system passing freely through a second of said two apertues.

14. The device of claim 12 wherein the first and second handles comprise disk-shaped structures.

15. The device of claim 13 wherein the first and second handles comprise spherical-shaped structures.

* * * * *